US010576612B2

(12) United States Patent
Vandenberg

(10) Patent No.: US 10,576,612 B2
(45) Date of Patent: Mar. 3, 2020

(54) METHOD OF USING A FASTENER GUIDE TO INSTALL A FASTENER

(71) Applicant: National Nail Corp., Grand Rapids, MI (US)

(72) Inventor: Roger A. Vandenberg, Hudsonville, MI (US)

(73) Assignee: National Nail Corp., Grand Rapids, MI (US)

( * ) Notice: Subject to any disclaimer, the term of this patent is extended or adjusted under 35 U.S.C. 154(b) by 2 days.

(21) Appl. No.: 15/915,391

(22) Filed: Mar. 8, 2018

(65) Prior Publication Data

US 2019/0275648 A1 Sep. 12, 2019

(51) Int. Cl.
*B25B 23/00* (2006.01)
*B25B 21/00* (2006.01)

(52) U.S. Cl.
CPC ..... *B25B 23/005* (2013.01); *B25B 21/007* (2013.01); *Y10T 29/49895* (2015.01); *Y10T 29/49947* (2015.01)

(58) Field of Classification Search
CPC ..... B25B 23/005; B25B 21/007; B25B 23/00; B25B 23/02; B25B 23/04; B25B 23/08; E04F 13/0894; Y10T 29/49947; Y10T 29/49963; Y10T 29/49895; Y10T 29/5343; Y10T 29/53909
See application file for complete search history.

(56) References Cited

U.S. PATENT DOCUMENTS

| | | | | |
|---|---|---|---|---|
| 797,078 | A | 8/1905 | Shelton | |
| 3,604,488 | A | 9/1971 | Wishart et al. | |
| 3,965,950 | A | 6/1976 | MacDonald | |
| 5,927,163 | A * | 7/1999 | Habermehl | B25B 23/045 227/136 |
| 8,955,210 | B2 | 2/2015 | Vandenberg | |
| 10,427,279 | B2 * | 10/2019 | Rensburg | B25B 5/003 |
| 2010/0083610 | A1 | 4/2010 | King | |

FOREIGN PATENT DOCUMENTS

| | | | | |
|---|---|---|---|---|
| EP | 0338554 | A2 * | 10/1989 | B25B 23/10 |
| EP | 0596669 | B1 * | 9/1997 | B25B 23/005 |
| EP | 2939790 | A1 * | 11/2015 | B25B 23/00 |
| GB | 846337 | A | 8/1960 | |
| WO | 2017000962 | A1 | 1/2017 | |

* cited by examiner

*Primary Examiner* — Sarang Afzali
(74) *Attorney, Agent, or Firm* — Warner Norcross + Judd, LLP

(57) ABSTRACT

A method of using a fastener guide to install a fastener that can include moving a funnel of the fastener guide over an upright fastener so that a head of the fastener is guided into and enters a barrel of the guide such that a drive feature can align and register with the head in the barrel. The method can include extending a gap flange of the guide into a gap between adjacent boards and advancing the fastener from the guide into the gap, and into a joist under the board to secure the board to the joist.

16 Claims, 12 Drawing Sheets

METHOD OF USING A FASTENER GUIDE TO INSTALL A FASTENER

BACKGROUND OF THE INVENTION

The present invention relates to tools, and more particularly to a tool and related method used to guide a tool bit or drive toward a fastener to facilitate installation of the fastener with the tool.

In the construction industry, there are many tools used to guide fasteners relative to a work piece. One example of a popular and durable tool is the CAMO Marksman Pro Tool, available from National Nail Corp of Wyoming, Mich. This tool is designed to efficiently guide fasteners at a predetermined angle directly into a side surface of a board. The fasteners are commonly referred to as "hidden fasteners" because they are generally hidden from view after installation with the tool.

Some hidden fasteners can be difficult to install due to their diminutive size and the location where they are installed. Where the fasteners are installed in crevices between boards, it can be difficult to mate and align the tool with the fastener to start the installation process. Further, if the head of the fastener is very small, it takes a careful, steady hand to align the bit of the tool with the head so that the tool can rotate the fastener using the tool. The problem of alignment can be exacerbated where the installer has poor vision. In some cases, it can take extra time to align the tool bit with the fastener. On a large job, where hundreds or thousands of fasteners are advanced into multiple work pieces, this alignment problem can be compounded, and can add time and labor cost to the job.

Accordingly, there remains room for improvement in the field of tools used to guide fasteners, and in particular, and alignment system to align a tool with a fastener and to properly and consistently engage the tool with the fastener for the driving activity.

SUMMARY OF THE INVENTION

A fastener guide and related method of use is provided. The guide can define a downward opening funnel having an upper end and an elongated barrel that is above the downward opening funnel and that transitions to and is in communication with the upper end. The funnel can be configured to be placed over an upright fastener so that a head of the fastener is guided into and enters the barrel, within which a drive feature can align and register with the head.

In one embodiment, the base can include a downward extending gap flange. The gap flange can extend downward from a bottom surface of the base. The gap flange can be disposed on opposite sides of the downward opening funnel, generally centered on a longitudinal axis of the elongated barrel and the downward opening funnel. The gap flange can be sized and configured to set a gap between boards placed adjacent one another before installation of a fastener.

In another embodiment, the guide can define an upward opening funnel above and transitioning to an upper opening of the elongated barrel. The upward opening funnel can be configured so that a drive feature can be guided by its surfaces, into the upper opening of the elongated barrel. From there, the drive feature can be aligned and quickly register with a head of the fastener so that the drive feature can be rotated and advance the fastener.

In still another embodiment, the guide can include a grasping region around the elongated barrel. The grasping region can be generally elongated and in some cases cylindrical, extending from the upper end of the downward opening funnel to the upward opening funnel. The exterior walls of the elongated barrel and the upward opening funnel can form all or part of the grasping region to reduce the weight and materials used to make the guide. The grasping region can be manually grasped by a user to position the guide adjacent an uptight fastener or near a work piece. Thereafter, the guide can be used to guide a drive feature, for example, a bit or a chuck, toward a head of a fastener so the drive feature can register with and rotate the fastener.

In yet another embodiment, the guide can be configured to releasably attach to a nose of an automatic fastener driving tool. The guide can include a registration feature, such as a groove, to align the guide with the nose. The guide can include a mounting element, such as one or more arms, to join and mount the guide to the nose. Once mounted, the guide can be placed over an upright fastener, and can be used to align a drive feature with a head of the fastener to subsequently install the fastener.

In a further embodiment, a method of using the fastener guide is provided, including the steps of providing a fastener in an upright, vertical orientation, distal from a guide; moving the guide toward the fastener so that a downward opening funnel moves over a head of the fastener and the head enters into an elongated barrel above the downward opening funnel; rotating the head in the elongated barrel with a drive feature in the elongated barrel such that the elongated barrel rotationally constrains the head and drive feature; and advancing the head with the drive feature so that the head passes into the downward opening funnel from the elongated barrel with the drive feature engaged with the head.

In still a further embodiment, the method can include moving the drive feature toward an upward opening funnel at a first angle relative to a longitudinal axis or barrel axis of the elongated barrel and engaging the drive feature against an interior wall of the upward opening funnel so that the drive feature moves along the wall toward an opening of the elongated barrel; and entering the drive feature into the elongated barrel such that the elongated barrel reconfigures the drive feature from the first angle relative to the longitudinal axis to a configuration substantially parallel to the longitudinal axis or barrel axis.

In even a further embodiment, the method can include positioning the downward extending gap flange in a gap between adjacent boards, and using that gap flange to set the final gap between the boards before the boards are secured in place. The bottom surface of the base can engage an upper surface of a board to orient a barrel axis of the elongated barrel orthogonal to a plane parallel to the upper surface of the board. The fastener can be advanced downward within the gap, but without advancing into the board.

In yet even another embodiment, where the guide includes an upward opening funnel, the method can include moving the drive feature into the funnel, and sliding the drive feature along an interior wall of the funnel downward toward an opening of the elongated barrel. The head can be engaged a first time with the drive feature while the head and the drive feature are located in the elongated barrel above the downward opening funnel.

In another further embodiment, the method can include placing a downward opening funnel over an upright, substantially vertical fastener; moving the guide so that the head of the fastener enters an elongated barrel above the downward opening funnel; setting a base on an upper surface of a board adjacent the fastener to secure the guide and barrel in an upright position to maintain the fastener in a vertical, upright position; guiding a drive feature of a tool into the upper opening of the elongated barrel so that the drive feature registers with the fastener in the barrel; and advancing the fastener with the drive feature.

The current embodiments of the fastener guide and related method of use provide benefits in fastener installation, fastener alignment and tool-to-fastener alignment that previously have been unachievable. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figures 3, 3A:
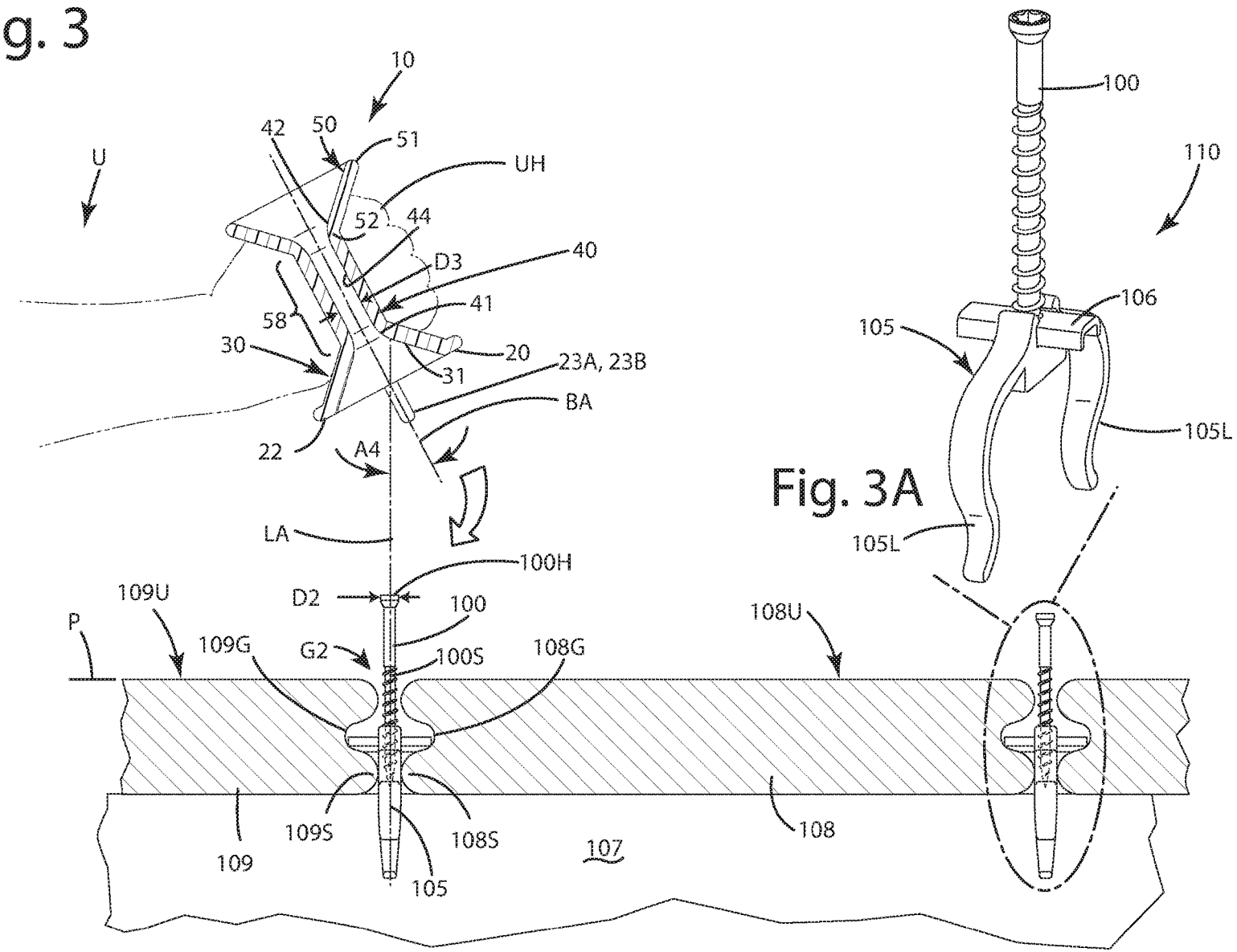
FIG. 3 is a section side view of the fastener guide taken along line 3-3 of FIG. 1, with the guide being moved toward a fastener in an upright, vertical position.
FIG. 3A is a perspective view of an optional clip used with a fastener.
Figure 4:
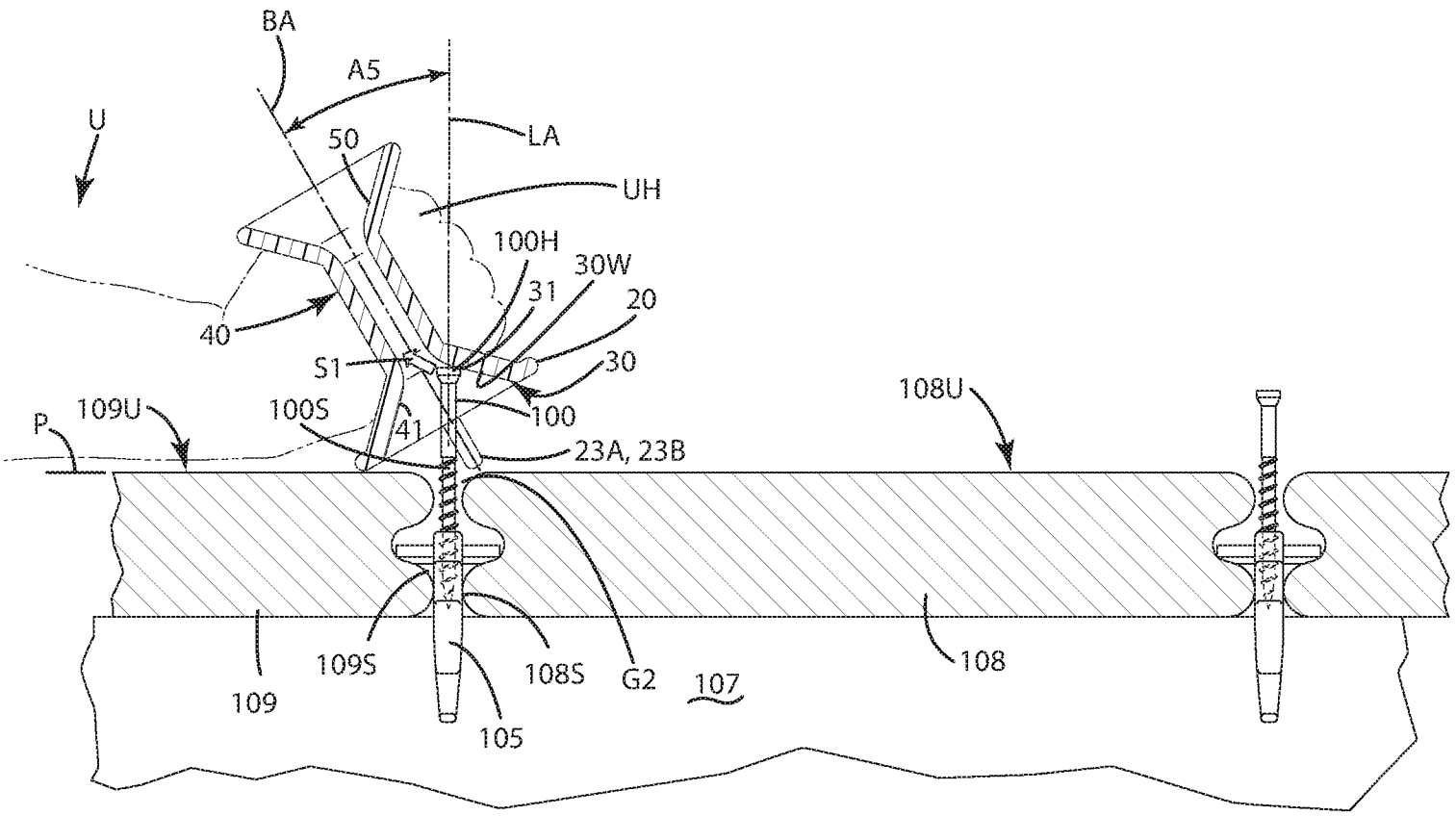
FIG. 4 is a section side view of the fastener guide being guided onto the fastener.
Figure 5:
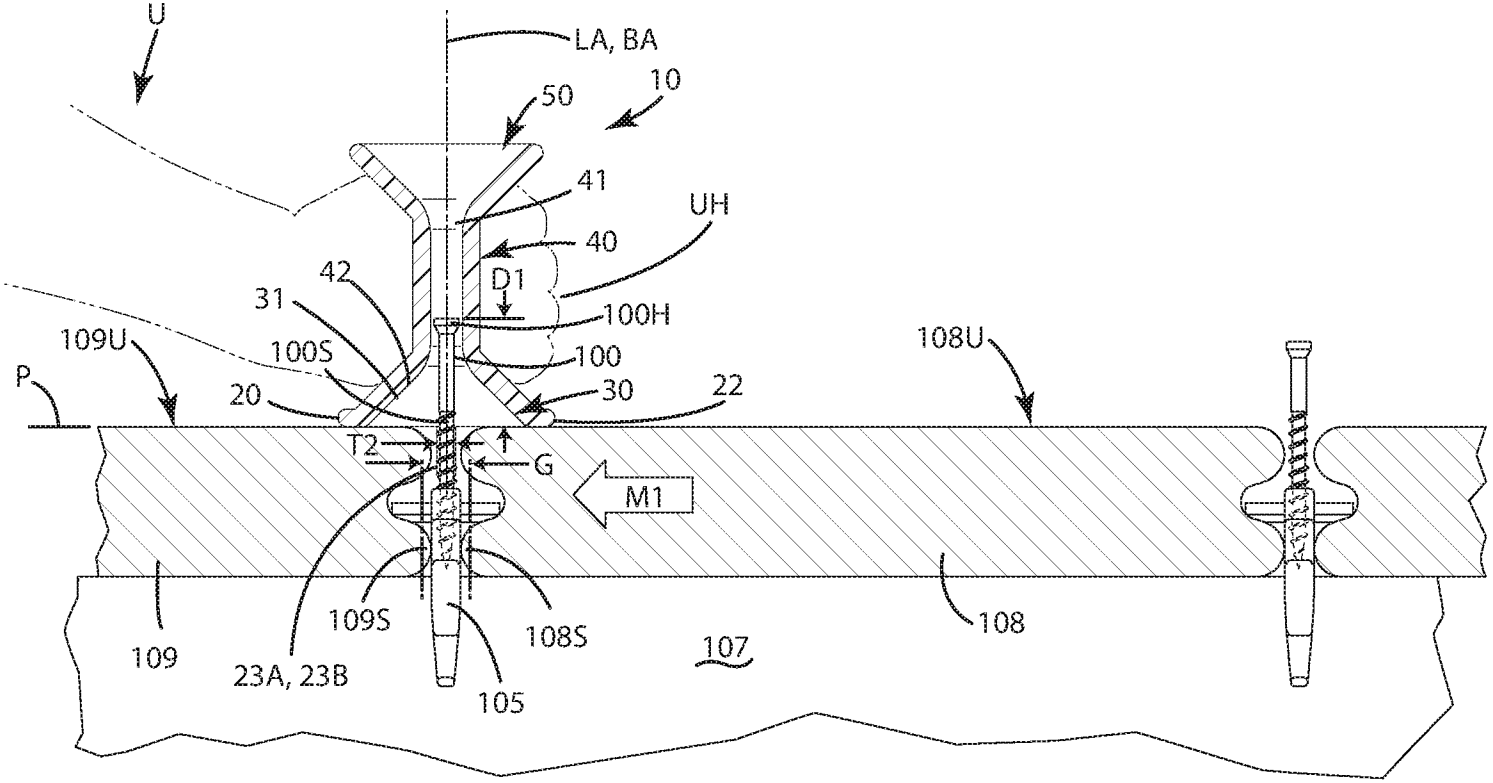
FIG. 5 is a section side view of the fastener guide installed relative to the fastener, generally maintaining the fastener in the vertical upright position and orthogonal to a plane of an upper surface of an adjacent board.
Figure 6:
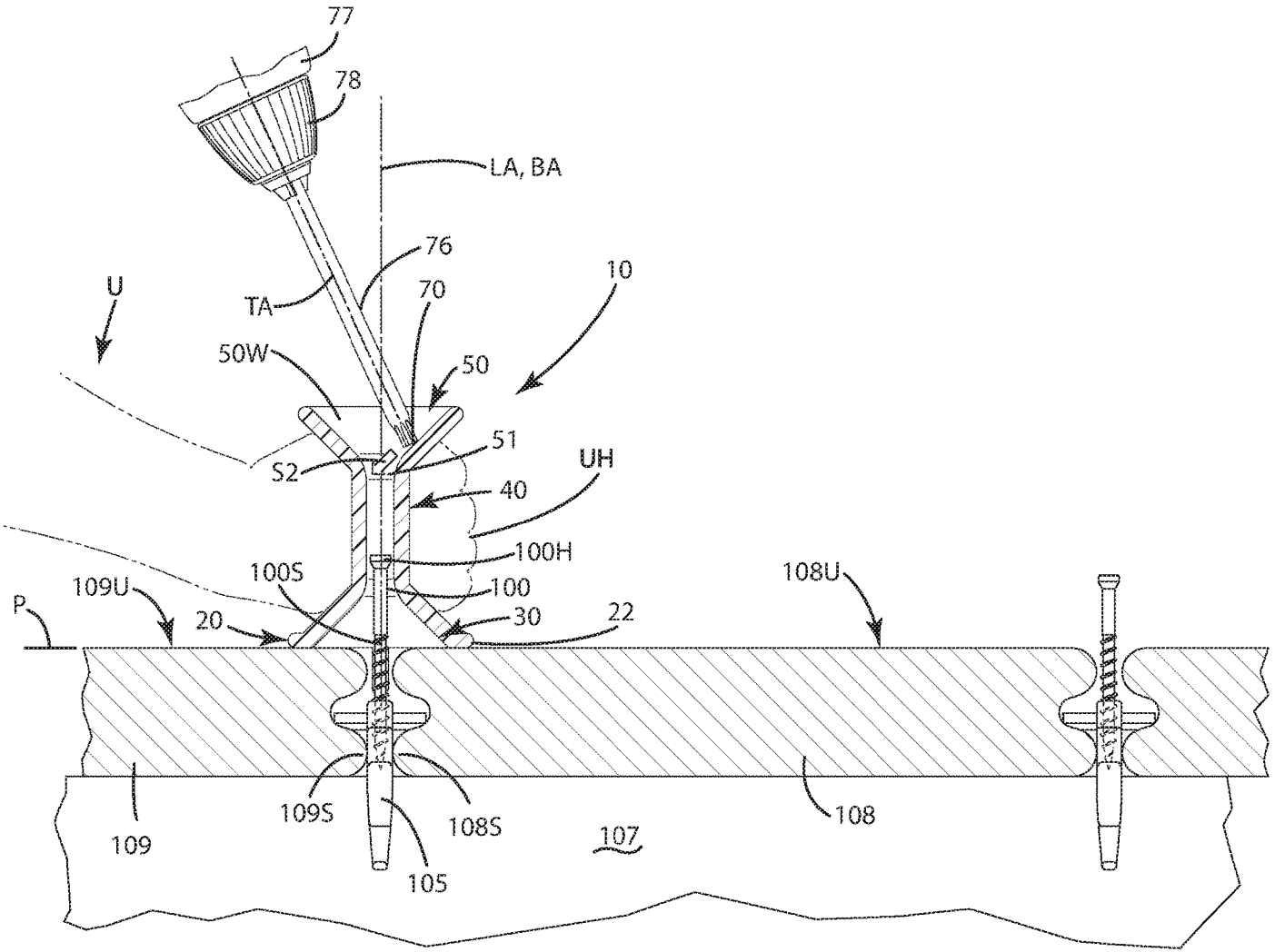
FIG. 6 is a section side view of the fastener guide installed relative to the fastener, with a drive feature being moved toward the fastener and being guided there by the fastener guide.

A current embodiment of the fastener guide of the current embodiment is illustrated in FIGS. 1-7, and generally designated 10. The fastener guide 10 includes a base 20 having a bottom surface 22 and optionally an opposing upper surface 21. The bottom surface 22 can have one or more downward extending gap flanges 23A, 23B. These flanges can be utilized to set a gap between adjacent boards 108, 109 adjacent a fastener 100. The fastener guide 10 can include an upward extending portion 24 which extends upwardly from the base 20. The guide 10 can define a downward opening funnel 30 that is disposed above the bottom surface 22 and optionally above the gap flanges 23A and 23B. The downward opening funnel can widen or open up to a larger dimension as it extends toward the bottom surface 22 as described below. The downward opening funnel 30 can include an upper end 31 and a lower end 32. The lower end 32 can transition directly to the bottom surface 22. The upper end 31 can transition to the elongated barrel 40. The barrel 40 can be defined above the downward opening funnel which can be configured to slide over a fastener 100 and its head tools and efficiently enters the elongated barrel a predetermined distance D1 (FIG. 5). The fastener remains in the upright substantially vertical orientation relative to the upper surfaces of adjacent boards. The guide optionally can include and define an upward opening funnel 50 above the elongated barrel 40. The upward opening funnel can transition to and can be in communication with the with an upper or second opening 42 of the elongated barrel 40, that opening 42 being distal from a lower or first opening 41 of the elongated barrel 40 that is immediately adjacent and/or occupies a common space with the upper end 31 of the downward opening funnel 30. Likewise, the upward opening funnel 50 can open an upward direction away from the bottom surface 22, generally becoming a larger dimension as distance from the elongated barrel increases. The upward opening funnel 50 can be configured to enable a drive feature 70 of a drive tool to quickly and efficiently ride along the interior wall 53 of that funnel 50 and into the elongated barrel 40 where it registers with and engages a head of the fastener 100.

By utilizing the fastener guide the current embodiment, a user can quickly install the guide 10 relative to an already in position fastener 100, rotationally constrain the head 100H of the fastener 100 in the elongated barrel 40, and insert a drive feature 70 into the guide 10, with the upward opening funnel 50 guiding the drive feature 70 automatically and consistently into the elongated barrel 40, where the drive feature registers with, aligns with and engages the head 100H of the fastener 100. From there, the drive feature 70 can be rotated, thereby rotating the fastener 100 and enabling it to be advanced into an underlying workpiece 109 such that one or more workpieces 108, 109 can be secured to that underlying workpiece 109.

For purposes of illustration, the current embodiment of the fastener guide 10 is described in connection with a manual fastener guide that can be placed manually relative to a fastener 100 and that can be manually held in place above one or more boards while the drive feature 70 is guided toward and advances the fastener 100 into an underlying joist 107. The boards 108, 109 and joist 107 can be referred to as workpieces, but workpieces refer also to other types of substrates and structures, not limited to wood, composite, metal, polymeric or other types of boards or workpieces. Further, although the guide 10 is described in connection with attaching boards to a joist, generally in the construction industry, the fastener guide can be used in a variety of other applications and industries where the fastener is advanced into a substrate or relative to another item. Optionally, the fastener described herein can be a rotatable fastener, such as a screw, having a head 100H and a shank 100S, where the shank includes one or more threads to assist in advancing and pulling the remainder of the fastener 100 into an underlying workpiece.

Generally, in the methods described herein, the fastener is already pre-located, partially installed in and held in a supported position. As illustrated, the position can be a vertical, upright position, but it is contemplated that this vertical, upright position also encompasses positions where the fastener is horizontal but otherwise held in a position relative to a vertical wall, or where the fastener is at an angle relative to a workpiece but held in place at that angle relative to the workpiece.

As described herein, the fastener can be held in the upright position utilizing a clip 105 as shown in FIG. 3. There, the clip 105 can include one or more legs 105L that assist in holding the fastener 100 adjacent and in some orientation relative to the workpiece 107 which again can be a joist. The clip can be the type and can include the features, structure and function as those clips in U.S. Provisional Application 62/545,709 to Vandenberg, filed Aug. 15, 2017, which is hereby incorporated by reference in its entirety.

As mentioned above, the fastener 100 can include ahead 100 H. This head can be of a dimension, such as a diameter D2 that is sized slightly smaller than a diameter D3 of the elongated barrel 40. This is so that the head 100H can consistently enter the elongated barrel 40 and slide therethrough, optionally while rotating. The diameter D3 can be slightly larger than D2, but not too large, so that the barrel rotationally constrains the head by the head rotating within and sliding along the sidewall 44 of the elongated barrel as the fastener is rotated. The head tools can include and/or define a drive, which optionally can be a hexalobular drive hole, a Phillips drive hole, a flat screwdriver drive hole, a hex key drive hole, a bolt head, or any other type of drive that is able to be engaged by a corresponding drive feature 70 of a tool 77.

The drive feature 70 used in conjunction with the current embodiment of the fastener guide 10 as mentioned above can take on a variety of configurations. Generally, the drive feature can be joined with and/or form a portion of an elongated bit 76. The bit can be installed in relation to the tool 77, and in particular a chuck 78 of the tool, to facilitate the securement of the bit 76 to the tool 77. The tool 77 can be an electric drill, a battery-powered drill, or any other type of tool capable of rotating a bit 76 and/or some type of drive feature 70.

The current embodiment of the fastener guide 10 as used herein is explained in connection with the installation of a particular type of fastener, although it may be utilized with a variety of other fasteners. For example, the fastener 100 as mentioned above can be attached to a clip 105. The fastener 100 can be configured to be installed adjacent one or more boards 108, 109 that lay transverse to an underlying joist 107. As an example, the boards 108, 109 can be perpendicular or otherwise transverse to the underlying joist 107 and can lay upon an upper edge of that joist 107. The upper surfaces 108U and 109U of those boards can lay in a common plane P. When placed, the fastener 100 can be orthogonal to that plane P. Of course, the clip 105 may be imperfect, or the joist 107 can be slightly warped or misshaped, in which case the fastener is not perfectly orthogonal to the plane P. In this case, where the fastener is within 1° to 10° off from being orthogonal relative to the plane, the fastener and its longitudinal axis LA is still considered to be orthogonal to the plane P.

Optionally, the fastener installed with the fastener guide 10 of the current embodiment is not installed through and does not penetrate the upper surfaces 108U, 109U of the boards. Instead, the fastener is advanced adjacent the side surfaces 108S, 109S of those boards. Those side surfaces 108S and 109S can face directly toward one another. As illustrated in FIG. 3, the side surfaces 108S, 109S can include corresponding grooves 108G, 109G. The clip 105 and/or its cleat 106 can be partially disposed in these grooves, with the assistance of the legs 105L on the joist, to support the fastener 105 in the upright, vertical configuration as shown. It is to be noted that the current embodiment is suitable for use with such an already-placed, upright and/or vertical standing, self-supported fastener (held and supported separate from the fastener guide 10). In some cases, however, instead of using a clip for this support function, the screw optionally can be partially pounded, hammered or forced slightly into a workpiece, for example, an upper surface 108U of a board. In that configuration, the fastener 100 is held in its upright, vertical orientation on its own, via its interaction with the board, rather than via a separate clip joined with the fastener.

Figure 1:
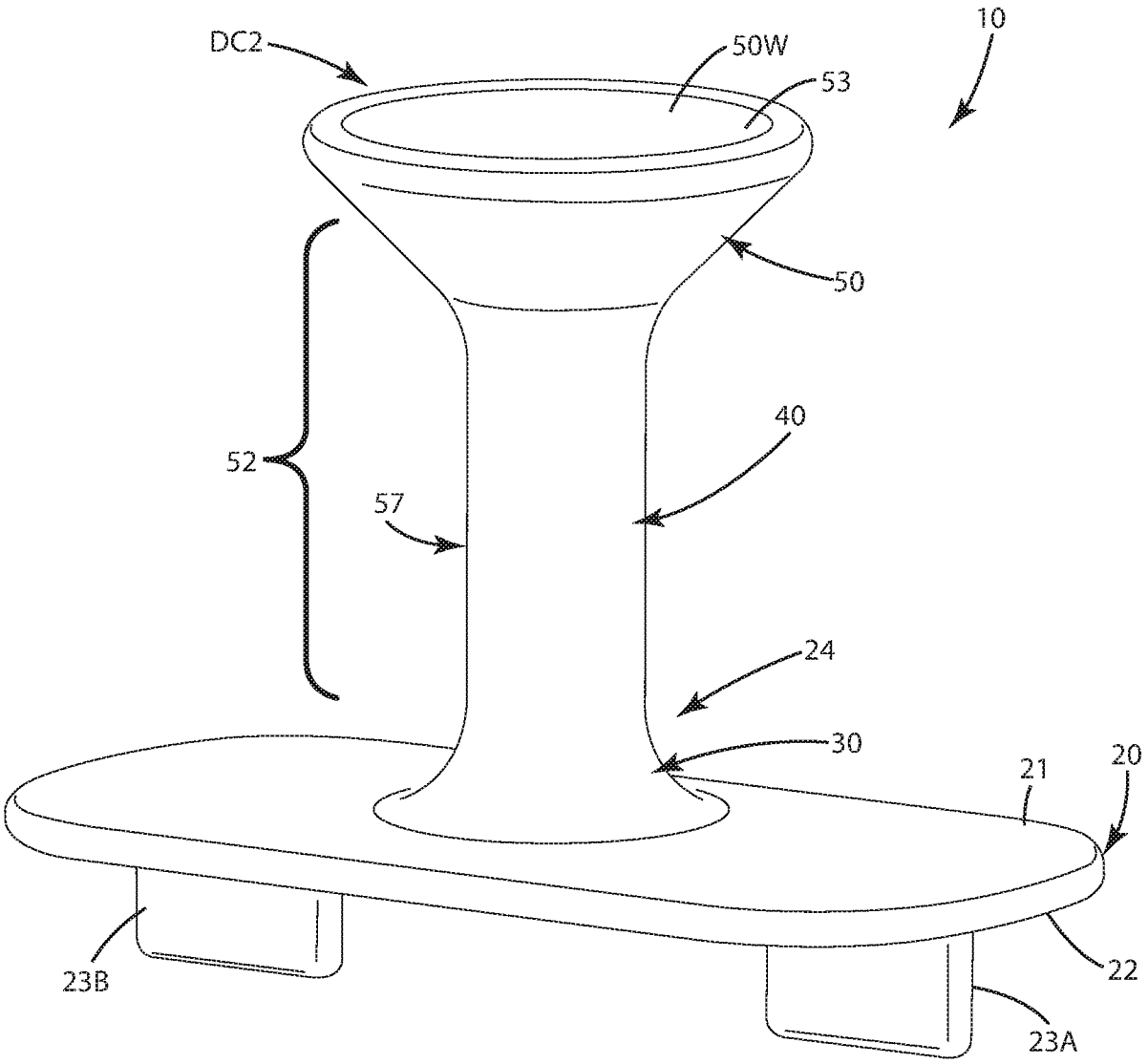
FIG. 1 is an upper perspective view of a fastener guide of a current embodiment.
Figure 2:
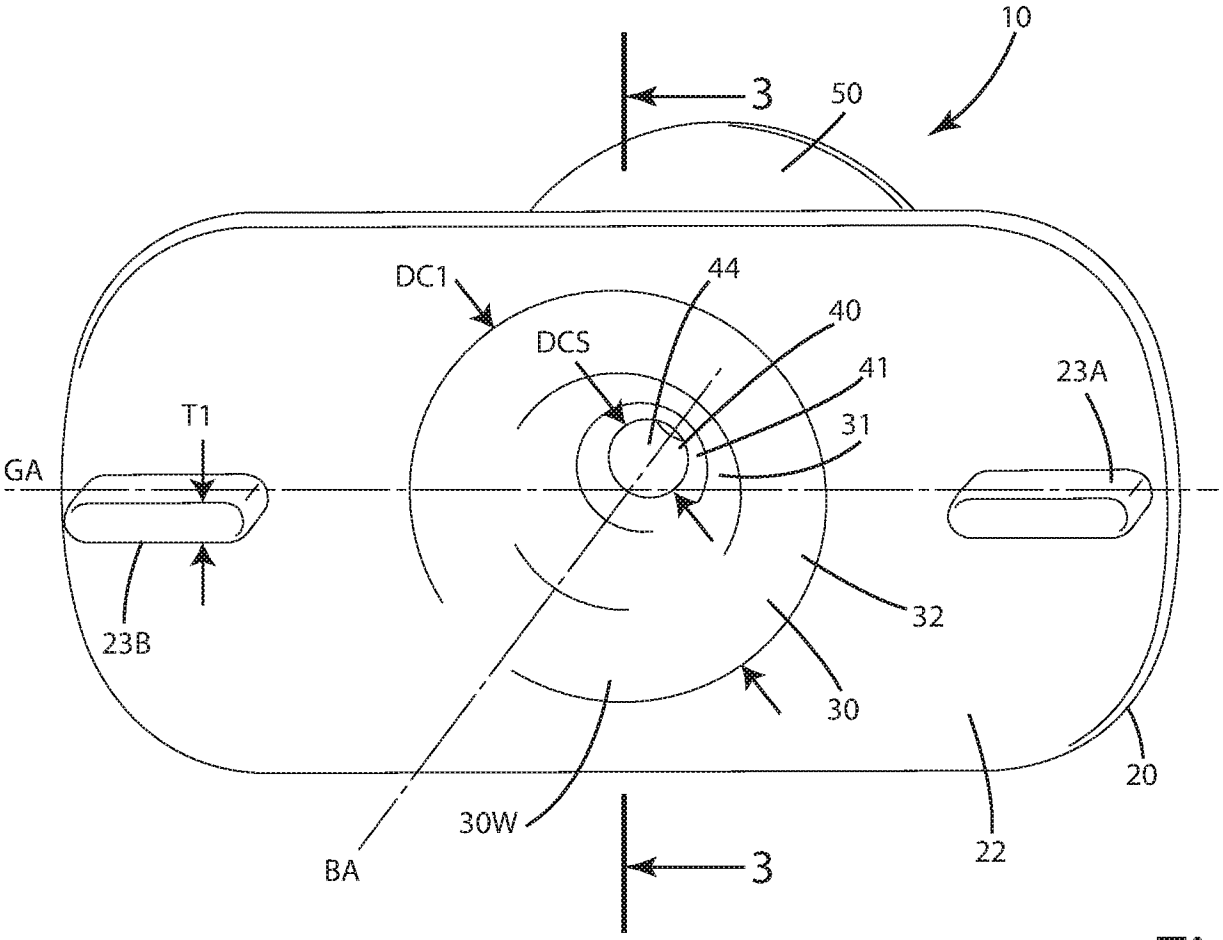
FIG. 2 is a lower perspective view of the fastener guide.

Turning now to FIGS. 1 and 2, the fastener guide 10 will be described in more detail. As mentioned above, the fastener guide 10 can include a base 20 having upper surface 21 and a bottom surface 22. The bottom surface can be substantially planar in most cases, but in others can be contoured. In some cases, the bottom surface can include a plurality of ridges or bumps to add grip and/or friction between the fastener guide 10 and an underlying board.

The bottom surface 22 can include the one or more gap flanges 23A, 23B. These gap flanges can be disposed on opposite sides of the opening 32 formed by the downward opening funnel 30. The gap flanges can be aligned along a common axis GA. That common axis GA can intersect the barrel axis BA, which is the longitudinal axis of the elongated barrel 40 of the fastener guide 10. This can be so that the fastener 100 advanced at least partially out from the barrel is disposed within a gap G (FIG. 5) that is set by the gap flanges 23A and 23B. The gap flanges can include a thickness T1 that can correspond to the final, desired gap G between adjacent boards 108, 109 and in particular between the adjacent side surfaces 108S and 109S. Indeed, after the fastener guide 10 is set in place, the boards 108, 109 can be moved toward one another, as shown in FIG. 5, in direction M1, so that side surfaces 108S and 109S engage each of the respective gap flanges on opposite sides of those flanges, compressing the flanges therebetween. With the gap G so set by the flanges and the fastener guide in general, the fastener can be advanced.

As illustrated, the gap flanges 23A and 23B can extend downward from the bottom surface 22 of the base 20. The gap flanges as illustrated are generally rectangular, of course other aesthetic designs, such as rectangular polygonal rounded or the like can be utilized as well. Further, there might only be one gap flange on one side of the barrel axis BA or funnel 30 in general, depending on the application.

With reference to FIGS. 1-2, the fastener guide 10 defines the downward opening funnel 30. This funnel can increase to a greater dimension the closer it gets to the bottom surface 22. As shown, the downward opening funnel 30 can be cone or frustoconical shaped. Where cone shaped, the diameter DC of the cone can decrease, taper or become less as the cone transitions toward the elongated barrel 40. Of course, the funnel 30 need not be perfectly cone-shaped. The inside of the funnel can be slightly rounded and/or partially spherical. The funnel can also include an interior wall 30W. This wall 30W can be generally smooth and/or featureless, optionally without any ridges, ribs or other pointed or edgy contours that can impair the sliding or movement of that wall along the generally stationary head or other portion of the fastener 100 so that the head can enter the elongated barrel 40. In other constructions, the funnel interior wall 30 can include ribs, ridges and/or recesses that generally point toward the upper end 31 or the opening 41 of the elongated barrel 40.

The funnel 30 can be constructed so that the smallest diameter DCS of the funnel, near the upper end 31 of the funnel, is larger than the diameter D2 of the head 100H of the fastener 100. This is so that the head 100H can enter the elongated barrel 40 through the end 31 or opening 41, generally above the upper end without being impaired by surfaces of the downward opening funnel 30. This diameter DCS of the funnel 30 can be substantially equal to or slightly greater than the diameter D3 of the elongated bore 40 in some applications.

The downward opening funnel 30 mentioned above transitions to the elongated barrel 40. As shown in FIGS. 1-3, the elongated barrel 40 can extend from the upper end 31 of the downward opening funnel 30 to the lower end 51 of the upward opening funnel 50. The elongated barrel can include an interior wall 44 as described above. This wall can be cylindrical or some other shape that enables and facilitates linear sliding and rotation of the head within the elongated barrel. Generally, the elongated barrel 40 can include a lower opening 41 and an upper opening 42. The lower opening 41 can be in communication with and can transition to the upper end 31 of the downward opening funnel 30. The upper opening 42 can be in communication with and transition to the lower end 52 of the upward opening funnel 50. The lower end 52 can be distal from and opposite the upper end 51 of the upward opening funnel 50.

The elongated barrel 40 can be substantially tubular and can have a uniform diameter D3. Again this uniform diameter D3 can be sufficient to engage the outer perimeter of a head 100H of fastener 100 as the fastener rotates therein. It can be slightly larger so that the head tools generally rotates about the barrel axis BA, and simultaneously about a longitudinal axis LA of the fastener which is substantially coincident with and parallel to the barrel axis BA. The barrel 40 can be set a predetermined distance D1 above the bottom surface 22 of the base 20, generally above the upper end 31 of the downward opening funnel 30. This distance D1 can be set so that the fastener head 100H (FIG. 5) is located substantially within the elongated barrel 40 when the bottom surface 22 engages in upper surface 108U, 109U of the adjacent boards 108, 109. The shaft 100S of the fastener 100 also can be at least partially within the elongated barrel 40 upon placement of the fastener guide 10 on the board upper surfaces. In some cases, optionally at least ⅛, further optionally at least ¼, even further optionally at least ½ the length of the fastener 100 can be disposed in the elongated barrel 40 when the bottom surface 22 of the base 20 engages the upper surfaces of the boards. Further, in this configuration, the shaft 100S can be disposed at least partially in the elongated barrel, above the upper end 31 and/or the opening 41, while another lower portion of the shaft 100S is disposed in the downward opening funnel, and yet another portion of the shaft 100S is disposed below the bottom surface 22 of the base, generally between the side surfaces 108S and 109S of the adjacent boards 108, 109 respectively.

With reference to FIGS. 1 and 5, the elongated barrel 40 transitions to the upward opening funnel 50. The upward opening funnel 50 includes an interior wall 50W which can be similar to the wall of the downward opening funnel, but facing and opening the opposite direction. Optionally, the interior wall 50W and funnel 50 in general can be cone-shaped, becoming larger in dimension further there from the base 20. Further optionally, the upward opening funnel and the downward opening funnel can be substantially the same in dimension from top to bottom, however, as illustrated, the contour of the respective interior walls differs, with the upward opening funnel being taller in height than the downward opening funnel. Of course, this can be altered depending on the application and the types of fasteners used during an installation process.

As shown in FIGS. 1 and 2, the elongated barrel 40, the downward opening funnel 30 and the upper opening funnel 50 can be reflected in outer or exterior surface 57 of the fastener guide 10. These various components and the respective exterior surfaces thereof can cooperatively form a grasping region 58 about which a user can manually grasp and manipulate the fastener guide 10. With this grasping region, the user can wrap one or more digits around the exterior surface of the barrel 40, and around at least a portion of the upward opening funnel and the downward opening funnel. The grasping region 58 can terminate below the upper opening 52 of the upward opening funnel 50, and can terminate at the upper surface 21 of the base 20. Of course, the grasping region can be altered in shape and contour for a particular application or an orientation of holding for the fastener guide 10.

A method of using the fastener guide to install a fastener will now be described in further detail with reference to FIGS. 1-7. To use the guide 10, a user U grasps with the user's hand UH the guide 10. This can be done by the user wrapping their digits about the grasping region 58 of the guide, generally between the base 20 and the outwardly projecting portion of the upward opening funnel 50. The user can utilize the guide in connection with a fastener 100 that is already supported separately in an upright, vertical orientation as illustrated in FIG. 3. There, the longitudinal axis LA of the fastener 100 is substantially vertical. The fastener 100 can be held in this substantially vertical orientation via a clip 105 that is joined with a joist 107 underlying the one or more boards 109 and 108. The legs 105L of the clip 105 can extend downwardly, adjacent opposite sides of the joist 107, thereby holding the clip 105 in an upward position, along with the fastener 100. The clip can include one or more cleats 106 that engage grooves 108G and 109G of the respective boards that are placed adjacent one another. The clip 105 is positioned between the side surfaces 108S and 109S of those boards. The fastener 100 and thus its shaft 100S and its head 100H are placed adjacent and generally between the side surfaces of the boards, and the boards themselves. The fastener projects upwardly from a gap G2 that is initially established between the adjacent side surfaces 108G and 109G of the boards. The fastener 100 and longitudinal axis LA thereof generally project vertically and orthogonal relative to a plane P that can pass through the upper surfaces 108U and 109U of the boards 108 and 109.

Sometimes, however, the longitudinal axis LA is not perfectly orthogonal, for example, it can be about 1° to 10° offset from being orthogonal to the plane P, and yet it is still considered orthogonal herein. Likewise, the longitudinal axis can generally be about 1° to 10° offset from vertical and yet still be considered vertical herein.

As the user U advances the guide 10 toward the fastener 100 and in particular the head 100H, the barrel axis BA can be offset at some angle A4 relative to the longitudinal axis LA of the fastener. The user can continue to advance the base 20 and the bottom surface 22 toward the upper surfaces 108U and 109U of the boards. During this movement, as shown in comparing FIGS. 3 and 4, the angle A4 can change to another different angle A5. Of course, the angle of the longitudinal axis LA relative to the barrel axis BA can vary considerably during this progression of the base 20 toward the upper surfaces of the boards 108U and 109U.

Eventually, the base 20 can come into close proximity to the upper surfaces of the boards. As it nears the upper surfaces, as shown in FIG. 4, the head 100H of the fastener 100 can engage the downward opening funnel 30 and in particular the sidewall or interior wall 30W thereof. When the fastener engages the sidewall 30W, it can slide along the generally featureless, smooth wall, being funneled and conveyed generally toward the upper and 31 of the downward opening funnel and the elongated barrel 40. This movement is indicated by the arrow 51 in FIG. 4. The head continues to slide along the wall until it passes the upper and 31 and generally through the lower opening 41 of the elongated barrel 40. The head continues to slide through the opening and into the elongated barrel. During this advancement, the gap flanges 23A and 23B can begin to enter the gap G2 between the side surfaces 108S and 109S of adjacent boards, generally over the portions of the clip 105 and beside the shaft 100S of the fastener 100. These flanges can eventually enter the gap G2.

During this movement of the fastener guide 10, the barrel axis BA also becomes more substantially aligned and optionally parallel to the longitudinal axis LA of the fastener. The head 100H of the fastener also can slide within and relative to the interior wall 44 of the elongated barrel 40 upward, in that elongated barrel, a preselected distance D1. Optionally, when the bottom surface of the base 20 engages the upper surfaces of the boards, this orients the longitudinal axis or barrel axis BA of the elongated barrel orthogonal to the plane P that is parallel to the upper surface of the board. It also can align the barrel axis BA parallel to the longitudinal axis LA of the fastener 100.

As shown in FIG. 5, the fastener guide 10 is installed with the fastener inside the guide 10. The base 20 and its bottom surface 22 rest against the upper surfaces 108U and 109U of the respective boards 108, 109. The gap flanges 23A, 23B are between the side surfaces 108S and 109S of the boards. The longitudinal axis LA of the fastener and the barrel axis BA are substantially aligned in parallel with one another as illustrated. Due to the resting of the bottom surface 2 on the upper surfaces of the boards, the fastener and longitudinal axis are held in an upright and vertical orientation adjacent the side surfaces of the respective boards. The fastener also can be substantially orthogonal to the plane P that passes through the upper surfaces of the boards.

With the gap flanges 23A, 23B in place, between the side surfaces of the boards, and adjacent the clip, one or more of the boards can be moved in direction M1 toward the other board so that the flanges 23A, 23B are pinched between the side surfaces 108S, 109S. Thus, the gap G attains the same dimension as the thickness T1 of the flanges 23A and 23B. This occurs while the base 20 remains atop the upper surfaces 108U, 109U of the boards. The fastener 100 also is held securely in place, and in the upright, vertical orientation by virtue of the head 100H being disposed in the elongated barrel 40. In this position, as mentioned above, the head 100H can be located substantially within the elongated barrel, above the upper end 31 of the downward opening funnel 30. The shaft 100S also can be at least partially within the elongated barrel 40, extending through the downward opening funnel 30, and generally disposed within the gap between the adjacent side surfaces of the boards. In addition, the shaft can be disposed between the flanges 23A and 23B.

With the boards properly positioned adjacent one another, being gapped by the optional flanges 23A and 23B, and the fastener 100 in the upright vertical orientation, the fastener can be advanced into the underlying joist 107 to secure the boards. In particular, with reference to FIG. 6, the user U can hold the fastener guide 10 in place, and can advance a tool 77 toward the fastener head 100H. The fastener guide facilitates this immensely. As shown, the user U can advance the drive feature 70 toward and into the upward opening funnel 50, generally past the upper end 52 thereof, toward the lower end 51 thereof. In so doing, the drive feature can engage the interior wall 50W of the upward opening funnel. Because the drive feature need only enter the large dimensioned upper end 52 of the funnel, it is easier for the user to align that small drive feature and place it into that funnel. When the drive feature 70 engages the interior wall 50W, it slides in direction S2 toward the elongated barrel 40. The tool axis TA initially can be misaligned by an angle A6 offset from the barrel axis and longitudinal axis LA of the fastener. Again, this angle can vary depending on the orientation of the tool 77. The user can then allow the drive feature 70 to slide along the funnel and through the lower end 51 of the funnel, directly into the elongated barrel 40. This occurs while the base 20 remains engaged with the upper surfaces of the board and the fastener is held in the upright, vertical position, optionally orthogonal to the plane P.

Figure 7:
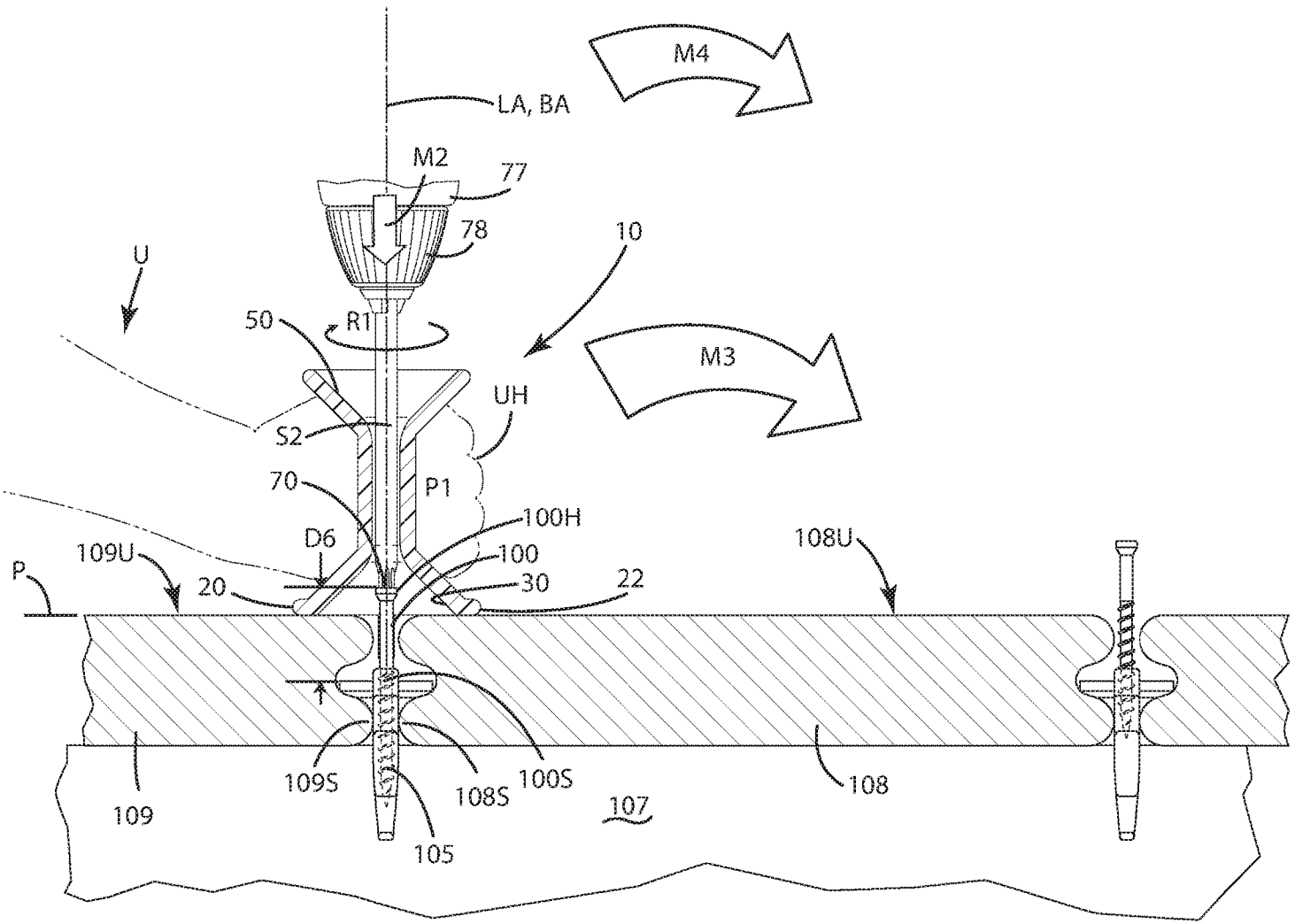
FIG. 7 is a section side view of the fastener guide installed relative to the fastener, with a drive feature engaging and advancing the fastener within the fastener guide.
Figure 8:
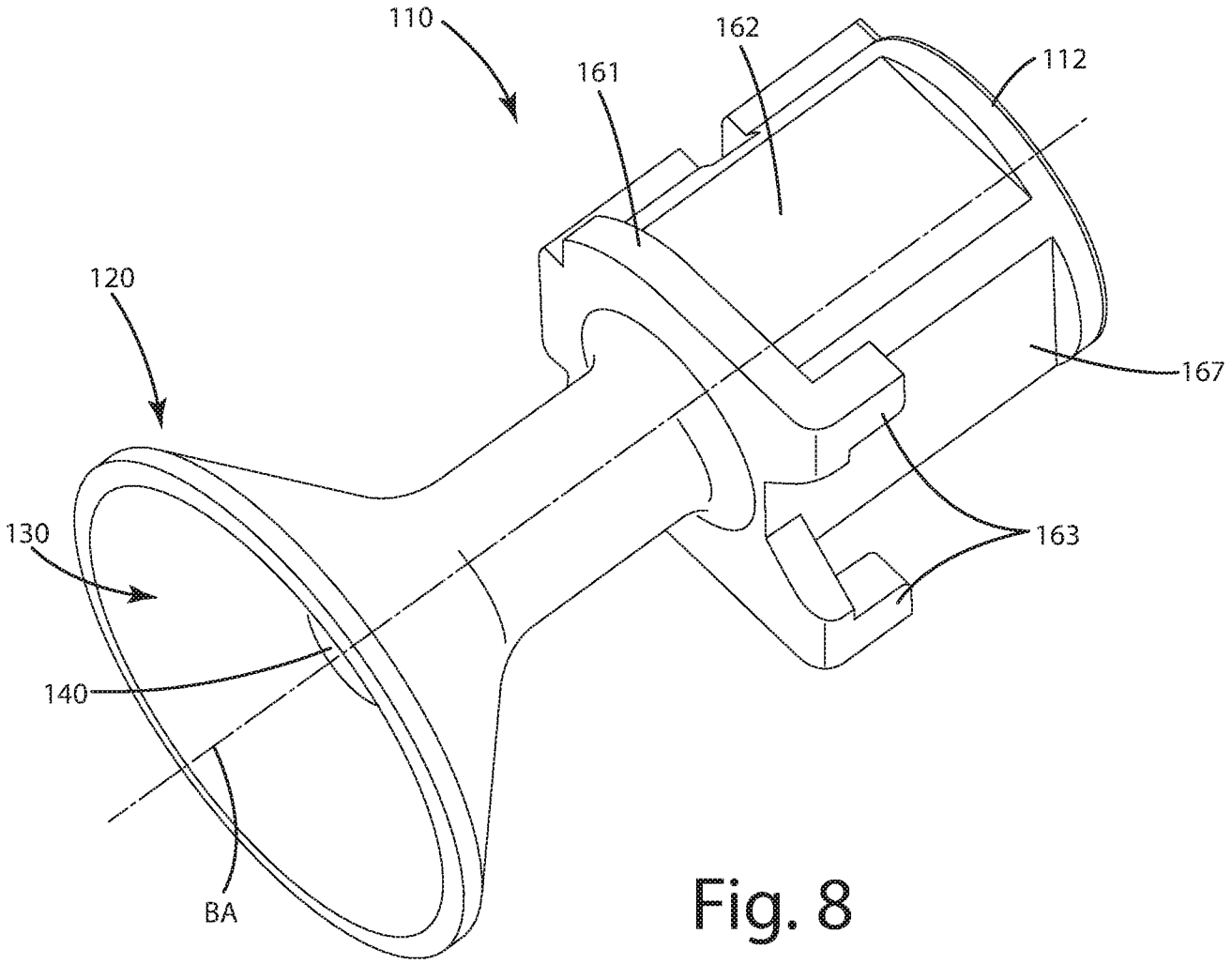
FIG. 8 is a perspective view of a first alternative embodiment of the fastener guide configured for attachment to a nose of an automatic fastener driving tool.

The advancement of the drive feature 70 can continue, and the drive feature 70 and its axis TA can become aligned with the longitudinal axis LA of the fastener and the barrel axis BA of the barrel 40 as shown in FIG. 7. There, the drive feature 70 can register with, or otherwise be joined with the head 100H the fastener 100 that remains disposed between and adjacent the side surfaces 108S and 109S of the boards. With the drive feature registered and aligned with the head 100H, the drive feature and the head are generally rotationally constrained in the elongated barrel 40. The user U can then apply rotational moment or force R1 to the drive feature 70 which turns the head 100H and the fastener 100. The fastener 100, fastener head and the drive feature 70 remain rotationally constrained in the elongated barrel as they rotate. The user can push downward on the tool 77, moving it direction M2, while the drive feature rotates in direction R1, generally while the tool axis, longitudinal axis of the fastener, and the barrel axis are aligned and in parallel.

The drive feature 70 advances in the barrel 40, rotating and engaging the head and rotating the fastener. During the engagement of the head of the fastener with a drive feature, the fastener can begin to bite into and move or advance into the joist 107. The drive feature 70 continues to engage the head during this advancing. The head and drive feature 70 pass through the barrel 40 and through the upper end 31 of the downward opening funnel 30. At some point, the head passes into the downward opening funnel 30 before the drive feature enters the downward opening funnel. The drive feature 70 and its associated bit 76 still remain rotationally constrained by the barrel 40, rotating in direction R1 in that barrel. When the fastener, and in particular the head 100H, enter the downward opening funnel 30, the fastener 100 is no longer rotationally constrained in the elongated barrel. The drive feature, associated with the bit 76, however remains rotationally constrained. The fastener is thus guided by the advancement of the drive feature, guided by the elongated barrel, downward into the underlying joist 107. The fastener continues to be advanced by the drive feature.

As this occurs, the drive feature and the head pass below the upper surfaces 108U, 109U of the boards. The head and drive feature 70 also pass adjacent the side surfaces 108S, 109S of the boards. The head 100H moves downward adjacent the side surfaces 108S, 109S of the boards to engage a cleat 106 of the clip 105. The fastener 100 moves downward thus a predetermined distance D6 until the head engages the cleat 106. As the head 100H engages the cleat 106, draws that cleat downward toward the joist 107, thereby pulling the boards 108 and 109 into further securement with that underlying joist.

After the fastener 100 is sufficiently installed as shown broken lines in FIG. 7, the user can withdraw the drive feature 70 from the fastener guide 10. As the user does this, the drive feature disengages the head 100H. The drive feature 70 thus passes upward in the barrel moving along the barrel axis BA. The drive feature can be withdrawn through the downward opening funnel 30, through the elongated barrel 40 and optionally out the upward opening funnel 50. In some cases, the user can elect to leave the drive feature in the elongated barrel as the user transfers the fastener guide 10 in direction M3 toward the next fastener 102 to be installed. In other cases, the user can completely withdraw the drive feature from the fastener guide 10 and separately move the tool with the drive feature attached to it in direction M4, such that the drive feature 70 again enters the fastener guide 10 in a manner similar to that above, with altering angles of the tool axis TA relative to the longitudinal axis LA of the fastener and the barrel axis BA. The user can continue to utilize the fastener guide 10 to install multiple upright, vertical fasteners relative to boards to secure those boards in place.

A first alternative embodiment of the fastener guide is illustrated in FIGS. 8-14 and generally designated 110. The fastener guide 110 can be similar to the fastener guide 10 described above in structure, function and operation, with several exceptions. For example, the fastener guide 110 can be configured to be permanently or at least temporarily secured to an automatic, fastener installation tool 177. This installation tool 177 can be referred to as a standup tool and can be operated by user standing upon two legs and advancing the tool and the guide 110 toward a fastener 200 which can be at least partially installed in a board 208. For example, the fastener can be partially installed with its tip 200T embedded the upper surface 208U of the board 208U. In this application, the fastener is not held in the upright vertical position with a clip. Incidentally, the fastener guide 10 described above also can be utilized in conjunction with this type of partially installed fastener 200, and a variety of other fasteners held in upright and/or vertical orientations generally.

Returning to FIGS. 8-9, the fastener guide 110 can include a base 120 and can define a downward opening funnel 130 in communication with an elongated barrel 140. These features and their corresponding structures can be substantially similar to that of the embodiment of the guide 10 described above and therefore will not be described again in detail here. In this case, however, the upward opening funnel can be deleted. This feature can be deleted because the fastener guide 110 can precisely and consistently be mounted relative to the tool 177, so that the tool axis TA, which extends in the direction that the drive feature 170 is guided, is substantially parallel to and aligned with the barrel axis BA. Thus, these elements and axes remain aligned with one another without having to cause such alignment via an upward opening funnel.

Figure 9:
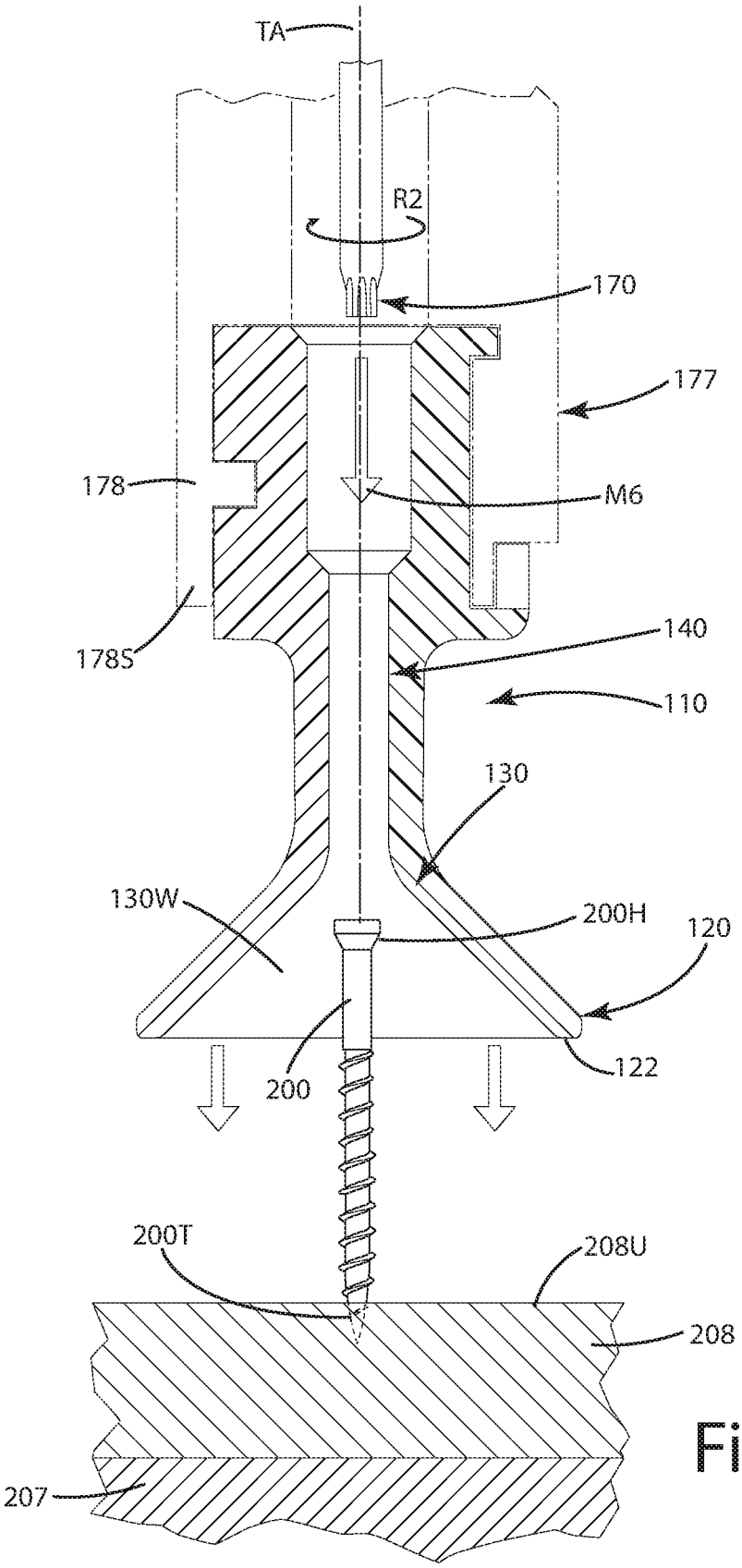
FIG. 9 is a section side view of the fastener guide of the first alternative embodiment, installed on an automatic fastener driving tool, about to engage a fastener supported separate from the guide in an upright, vertical position.
Figure 10:
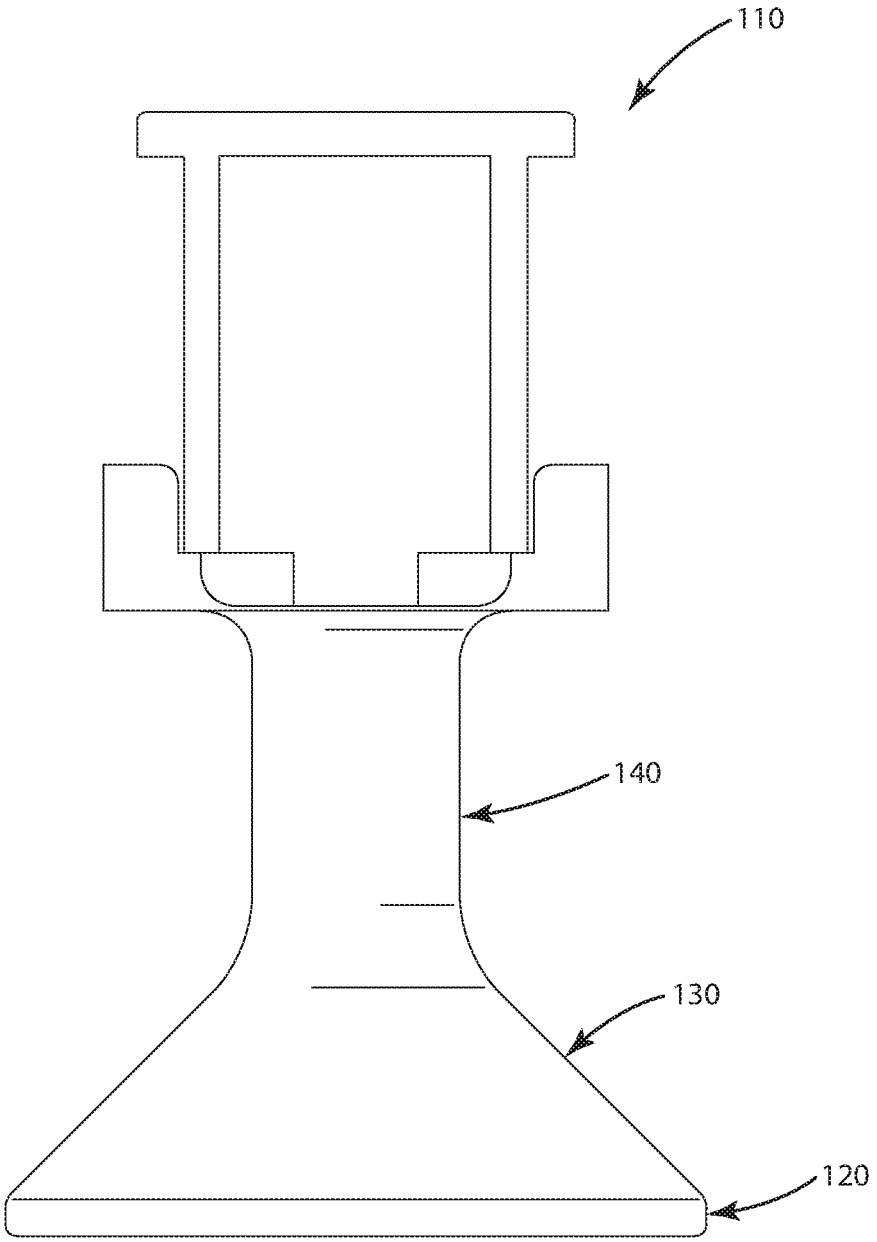
FIG. 10 is a front view of the fastener guide of the first alternative embodiment.
Figure 11:
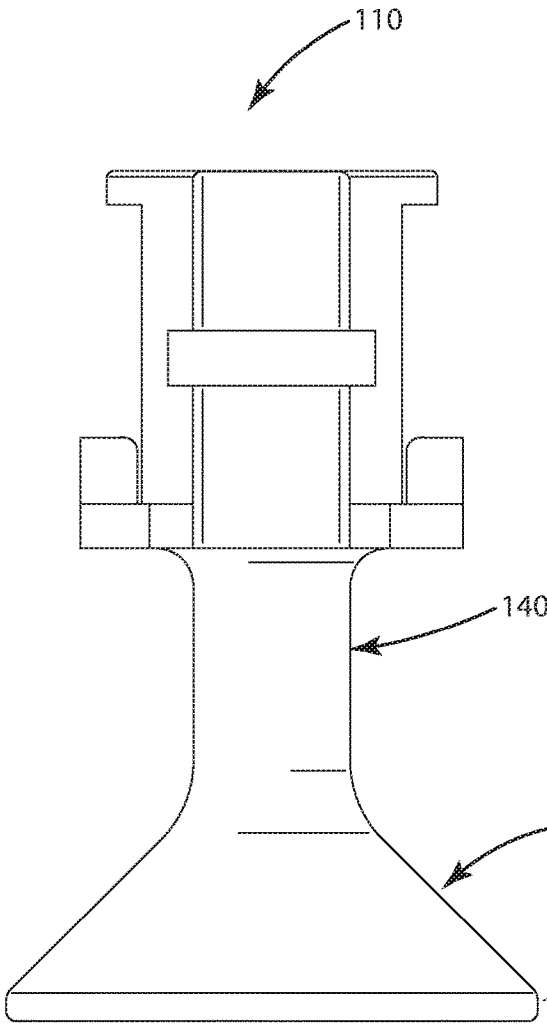
FIG. 11 is a rear view thereof.
Figure 12:
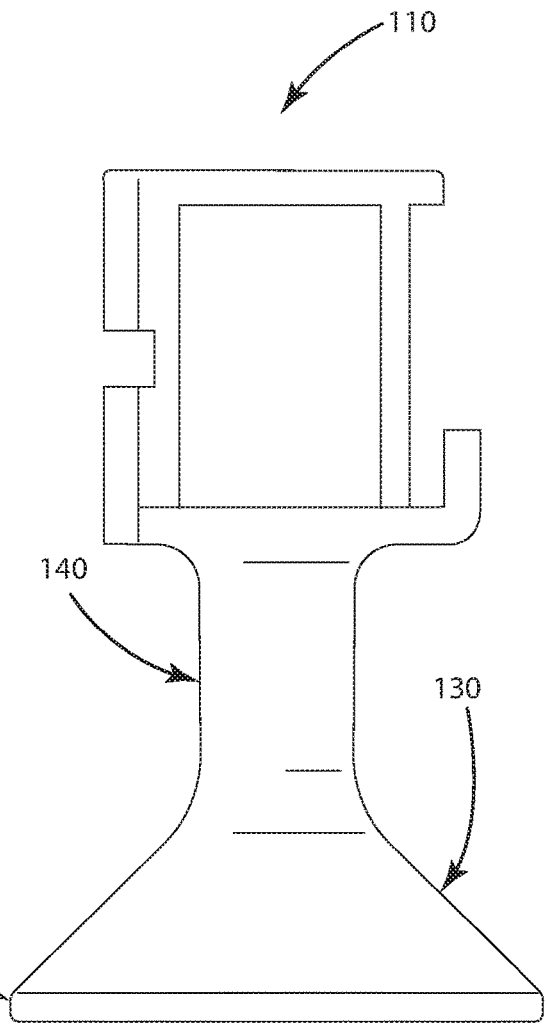
FIG. 12 is a right side view thereof, the left side view being a mirror image thereof
Figure 13:
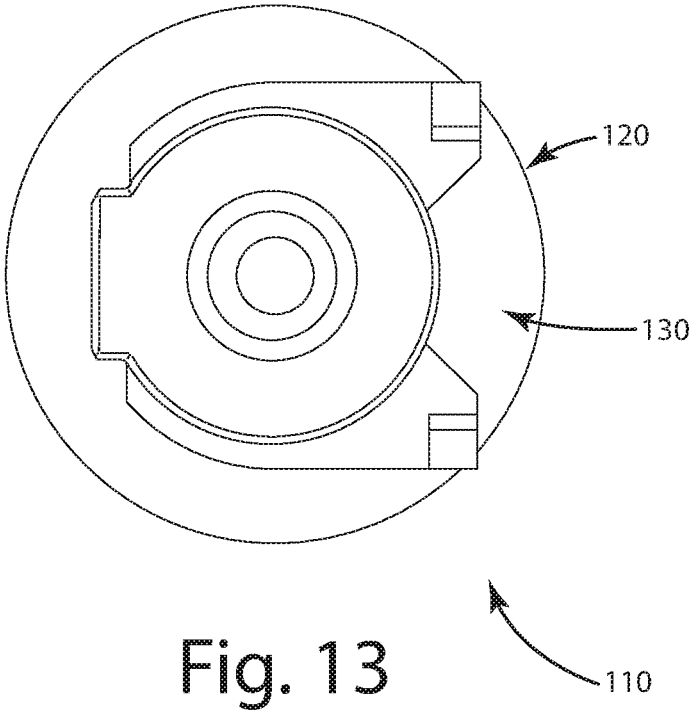
FIG. 13 is a top view thereof.
Figure 14:
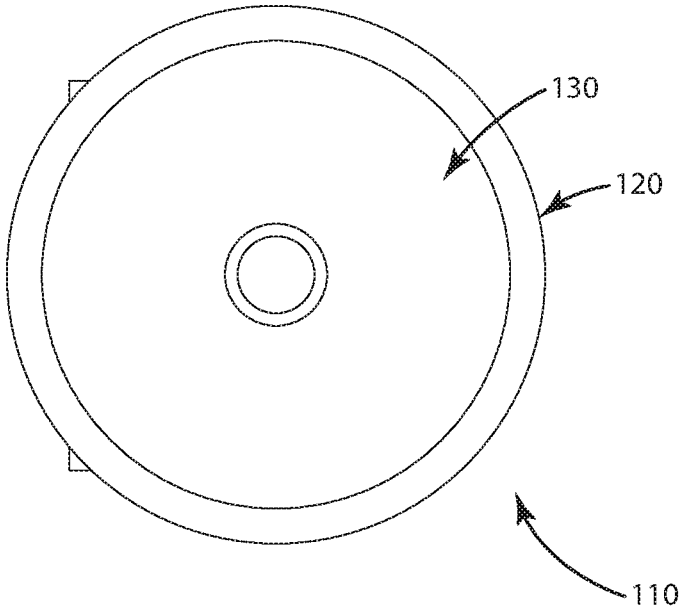
FIG. 14 is a bottom view thereof.

This fastener guide 110 can include a ring 161 that engages a shoulder 171S of the tool 177 and in particular a nose 178 of the tool. The fastener guide 110 can include one or more registration features. For example, it can include anti-rotation flats 162 that prevent the fastener guide 110 from rotating relative to the nose 178. The fastener guide also can include a groove 167 which can align the guide with the nose 178. The guide 110 can include one or more mounting elements, such as the mounting arms 163 that project upward, toward the second end 112 of the guide 110. These mounting arms 163 can assist in mounting and securing the guide 110 to the nose 178 as shown in FIG. 9.

The method of using the fastener guide 110 associated with the stand-up, automatic tool 177 is similar to that of using the guide manual guide 10 described above. Generally, a user can move the guide 110 toward a fastener 200 having a head 200H. The head 200H can move along an interior side wall 30W of the downward opening funnel 130 until the head 200H enters the elongated barrel 140. The user can know that this occurs when the bottom surface 122 of the base 120 engages the upper surface 208U of board 208. The user can engage the drive element 170, moving it in a direction M6 toward the head 200H to engage the head. As this occurs, the drive element 170 can rotate in direction R2 to rotate the fastener 200 so that advances into the board 208, optionally securing it to the underlying board 207.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of using a fastener guide to install a fastener, the method comprising:

providing a fastener in an upright, vertical orientation adjacent a side surface of a board, the fastener being held in the upright, vertical orientation via a clip joined with a joist underlying the board, the board including an upper surface disposed at an angle relative to the side surface of the board;

moving a guide from a distal location toward the fastener, the guide including a base having a downward extending gap flange and a bottom surface, the guide defining a downward opening funnel that widens toward the base and has an upper end, the guide defining an elongated barrel above the downward opening funnel, the elongated barrel transitioning to the upper end;

sliding the downward opening funnel over a head of the fastener, so that the head of the fastener enters the elongated barrel and the head of the fastener is disposed in the elongated barrel, and so that the gap flange extends adjacent the side surface of the board, with the bottom surface of the base placed on the upper surface of the board when the gap flange extends adjacent the side surface of the board, within a gap between the board and another board;

advancing a drive feature in the barrel, the drive feature rotating and engaging the head of the fastener so as to rotate the fastener; and advancing the fastener adjacent the board using the drive feature so that the fastener exits the elongated barrel and travels through the downward opening funnel, while the guide remains in place adjacent the board, and so that the fastener advances into the joist without advancing into the board.

2. The method of claim 1, wherein the head and drive feature are rotationally constrained in the elongated barrel before the drive feature enters the downward opening funnel, at which point the fastener is no longer rotationally constrained in the elongated barrel but is guided instead by the advancement of the drive feature downward into the board.

3. The method of claim 2 comprising:

placing the drive feature in an upward opening funnel before the drive feature enters the elongated barrel, sliding the drive feature relative to a wall of the upward opening funnel toward an upper opening of the elongated barrel, wherein the elongated barrel includes a lower opening that is in communication with the upper end of the downward opening barrel.

4. The method of claim 1, comprising:

placing the bottom surface of the base against the upper surface of the board such that a barrel axis of the elongated barrel is orthogonal to the upper surface of the board, wherein the elongated barrel engages and tilts the fastener so that the fastener is disposed in the upright, vertical orientation and so that a longitudinal axis of the fastener is orthogonal relative to the upper surface of the board.

5. The method of claim 4, wherein the guide includes an upward opening funnel including a smooth, featureless first interior wall, wherein the downward opening funnel includes a smooth, featureless second interior wall, wherein the fastener slides relative to the second interior wall up into the elongated barrel as the guide is moved toward the board, wherein the drive feature slides relative to the first interior wall down into the elongated barrel as the drive feature is moved toward the head of the fastener.

6. The method of claim 1, wherein the fastener is immediately adjacent the board side surface, wherein during the advancing the fastener step, the head of the fastener moves downward adjacent the board side surface a predetermined distance until the head engages a cleat of the clip.

7. The method of claim 1, wherein the elongated barrel includes a barrel axis that is orthogonal relative to the bottom surface.

8. The method of claim 1 comprising:

engaging the head of the fastener with the drive feature when both the head and the drive feature are located in the elongated barrel;

continuing to engage the head of the fastener with the drive feature after the head descends below the upper end of the downward opening funnel, and the head of the fastener is not engaging the elongated barrel, continuing to engage the head of the fastener with the drive feature after the head descends below an upper surface of the board.

9. A method of using a fastener guide to install a fastener, the method comprising:

providing a fastener in an upright, vertical orientation, the fastener being distal from a guide in this orientation;

moving the guide toward the fastener so that a downward opening funnel slides relative to a head of the fastener and the head enters into an elongated barrel above the downward opening funnel, and so that a gap flange of the guide extends in a gap between adjacent boards;

rotating the head in the elongated barrel with a drive feature located in the elongated barrel, with the elongated barrel rotationally constraining the head and drive feature;

advancing the head with the drive feature so that the head passes into the downward opening funnel from the elongated barrel with the drive feature engaging the head; and advancing the fastener in the gap between the adjacent boards and into a joist under the adjacent boards, but without the fastener advancing into either of the adjacent boards, so that the adjacent boards are secured to the joist under the adjacent boards, while the guide engages an upper surface of at least one of the adjacent boards, while the gap flange is in the gap between the adjacent boards.

10. The method of claim 9, wherein a bottom surface of a base of the guide engages the upper surface of the at least one of the adjacent boards, to orient a barrel axis of the elongated barrel orthogonal to a plane parallel to the upper surface of the at least one of the adjacent boards.

11. The method of claim 10, wherein the guide includes an upward opening funnel along the elongated barrel, the upward opening funnel including a smooth, featureless first interior wall, wherein the downward opening funnel includes a smooth, featureless second interior wall, wherein the fastener slides relative to the second interior wall into the elongated barrel as the guide is moved toward the at least one of the adjacent boards, wherein the drive feature slides relative to the first interior wall into the elongated barrel as the drive feature is moved toward the head.

12. The method of claim 11 comprising:

engaging the head a first time with the drive feature while the head and the drive feature are located in the elongated barrel above the downward opening funnel, and between an upper opening of the elongated barrel and a lower opening of the elongated barrel.

13. The method of claim 12, wherein the downward opening funnel is a cone shaped void having an upper end that opens to the elongated barrel, wherein the head is of a head diameter smaller than a smallest diameter of the cone shaped void so that the head enters the elongated barrel above the upper end without being impaired by a surface of the downward opening funnel.

14. The method of claim 13, wherein the head of the fastener engages a sidewall of the elongated barrel such that a fastener longitudinal axis of the fastener is aligned with a barrel axis of the elongated barrel as the fastener is rotated with the drive feature.

15. The method of claim 10, wherein the downward opening funnel is a cone shaped void having an upper end that opens to the elongated barrel, wherein the head is of a head diameter smaller than a smallest diameter of the cone shaped void so that the head enters the elongated barrel above the upper end without being impaired by a surface of the downward opening funnel.

16. The method of claim 9 comprising:

moving the drive feature toward an upward opening funnel at a first angle relative to a barrel axis of the elongated barrel, engaging the drive feature against an interior wall of the upward opening funnel so that the drive feature slides downward toward an opening of the elongated barrel;

entering the drive feature into the elongated barrel such that the elongated barrel reconfigures the drive feature from the first angle relative to the barrel axis to a configuration parallel to the barrel axis.

* * * * *